US009003593B2

(12) United States Patent
Newell

(10) Patent No.: US 9,003,593 B2
(45) Date of Patent: Apr. 14, 2015

(54) TWISTED TUBULAR WEB ELEMENT AND MOP HEAD MADE THEREFROM

(71) Applicant: Robert D Newell, Williamsburg, VA (US)

(72) Inventor: Robert D Newell, Williamsburg, VA (US)

( * ) Notice: Subject to any disclaimer, the term of this patent is extended or adjusted under 35 U.S.C. 154(b) by 0 days.

(21) Appl. No.: 14/211,521

(22) Filed: Mar. 14, 2014

(65) Prior Publication Data

US 2014/0259495 A1 Sep. 18, 2014

Related U.S. Application Data

(60) Provisional application No. 61/790,758, filed on Mar. 15, 2013.

(51) Int. Cl.
*A47L 13/20* (2006.01)
*A47L 13/255* (2006.01)

(52) U.S. Cl.
CPC ..... *A47L 13/20* (2013.01); *A47L 13/255* (2013.01)

(58) Field of Classification Search
CPC ..... A47L 13/20; A47L 13/255
USPC ..... 15/228, 229.1
See application file for complete search history.

(56) References Cited

U.S. PATENT DOCUMENTS 4,717,616 A * 1/1988 Harmon et al. ..... 428/195.1
4,752,985 A * 6/1988 Quearry et al. ..... 15/229.1
4,995,133 A 2/1991 Newell

* cited by examiner

*Primary Examiner* — Randall Chin
(74) *Attorney, Agent, or Firm* — Peter J. Van Bergen

(57) ABSTRACT

A tubular web element is made from a strip of fabric having opposing longitudinal edges. The strip is longitudinally twisted to define a hollow tube having between approximately 0.01-0.95 turns per inch. At least one helical gap is defined between the opposing longitudinal edges of the hollow tube. The opposing longitudinal edges have self-fused edge regions. The hollow tube has self-fused longitudinally-extending regions between its opposing longitudinal edges.

16 Claims, 6 Drawing Sheets

TWISTED TUBULAR WEB ELEMENT AND MOP HEAD MADE THEREFROM

Pursuant to 35 U.S.C. §119, the benefit of priority from provisional application 61/790,758, with a filing date of Mar. 15, 2013, is claimed for this non-provisional application.

FIELD OF THE INVENTION

The invention relates generally to mops, and more particularly to a web element that is both twisted and tubular, and mop heads made from such web elements.

BACKGROUND OF THE INVENTION

A variety of wet and dry mop constructions are known in the art. Such constructions include those utilizing mop elements made from twisted natural or synthetic fiber or yarns as well as those made from planar web elements of woven or non-woven materials having involutions or twists formed along the length thereof. Regardless of their construction, a good mop strives to achieve the following goals:

- the ability to absorb or pick-up liquid and/or particulate accumulations on a floor surface,
- the ability to release the absorbed or picked-up liquid and/or particulate when the mop is compressed,
- the ability to be used effectively on a rough floor surface without tearing or generating lint during use,
- the ability to withstand multiple launderings while maintaining structural integrity and its absorption, retention, and release properties, and
- the ability to eliminate linting or shedding during general handling.

Current mop constructions can provide some, but not all, of these properties. For example, U.S. Pat. No. 4,995,133 teaches a mop made from planar web elements that can be processed to form involutions or twists along the length thereof to create capillaries that increase absorption and retention of liquid and/or particulates. The involutions/twists can be maintained by either overwrapping a helical strand about the web element or by applying adhesive along the web element. However, both of these approaches present problems. In the case of a helical overwrap, the overwrapping tension must be tightly controlled as the involutions/twists will not be maintained if the overwrap is too loose while the capillary effect of the involutions/twists will be inhibited/negated if the overwrap is too tight. In the case of adhesion bonding, points or areas of adhesion between web element surfaces define "catch points" for particulate matter in the mop element that can inhibit the capillary effect. Furthermore, upon laundering of such adhesion-bonded mop elements, the points of adhesion form stress points that can lead to tearing of the web elements adjacent to the bond region since the bond region is often stronger that the material being bonded. The resulting tears diminish the capillary effect and define new regions for lint to be released from the mop element during use thereof.

SUMMARY OF THE INVENTION

Accordingly, it is an object of the present invention to provide a mop element for use in wet and dry mop applications.

Another object of the present invention is to provide a mop element having good absorption, retention, and release properties.

Still another object of the present invention is to provide a mop element that resists tearing and the generation of lint during use.

Yet another object of the present invention is to provide a mop element that retains its properties after being laundered and dried.

Other objects and advantages of the present invention will become more obvious hereinafter in the specification and drawings.

In accordance with the present invention, a tubular web element is made from a strip of fabric having opposing longitudinal edges. The strip is longitudinally twisted to define a hollow tube having between approximately 0.01 turns per inch to approximately 0.95 turns per inch along a length of the hollow tube. At least one helical gap is defined between the opposing longitudinal edges of the hollow tube. The opposing longitudinal edges have self-fused edge regions therealong. The hollow tube has self-fused longitudinally-extending regions between its opposing longitudinal edges.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
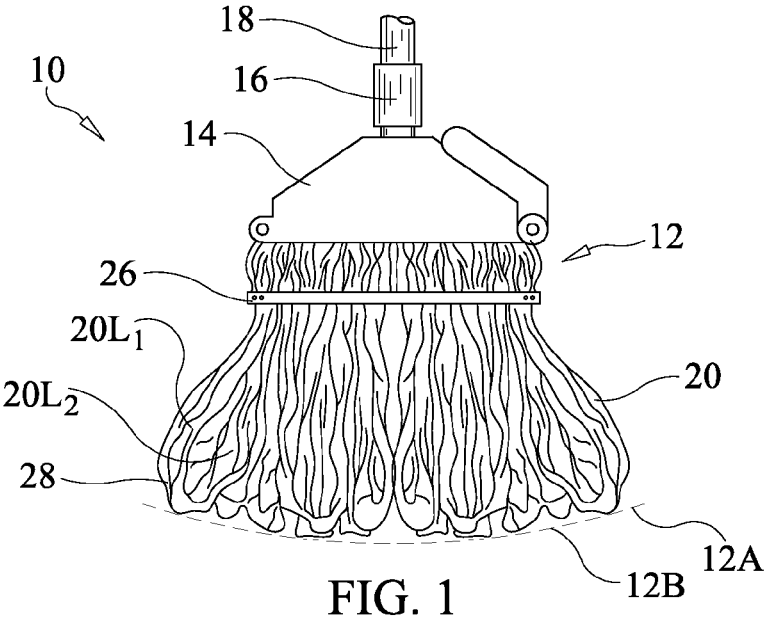
FIG. 1 is a front view of a portion of a mop using a mop head constructed from mop elements in accordance with an embodiment of the present invention.
Figure 2:
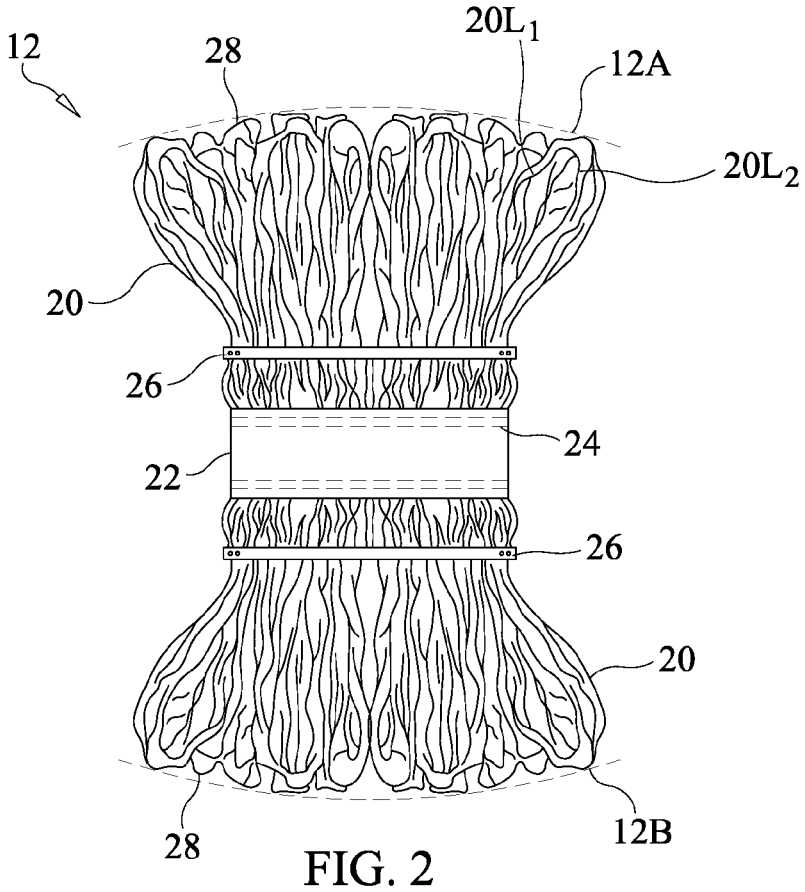
FIG. 2 is a plan view of a mop head constructed from a continuous length or multiple lengths of twisted and looped mop elements in accordance with an embodiment of the present invention.

Referring now to the drawings, simultaneous reference will be made to FIGS. 1 and 2 where a mop 10 for removing liquid and/or particulate accumulations on a floor surface uses a mop head 12 constructed from web elements 20 in accordance with an embodiment of the present invention. Mop 10 includes mop head 12 connected to a retention yoke 14 that includes a fitting 16 connected to a mop handle 18. It is to be understood that the construction of the various parts used to support mop head 12 can be different from that shown without departing from the scope of the present invention.

Mop head 12 includes a plurality of web elements 20 that start as planar strips of material which are then twisted into a loose hollow tubular shape that is looped back onto itself at the mop head's distal ends 12A and 12B. That is, each twisted tubular web element 20 I mop head 12 has substantially adjacent and spaced-apart legs 20$L_1$ and 20$L_2$ terminating in a free end loop 28 at one of distal ends 12A and 12B. A backing member in the form of a head band 22 is wrapped about the central portions of the twisted and looped web elements 20 and connected thereto by stitching 24. The twisted and looped elements 20 are gathered and connected to tail bands 26 by stitching thereby establishing free end loops 28 at distal ends 12A and 12B of mop head 12. The position of tail band 26 relative to free end loops 28 can be adjusted to provide the desired length of free ends for the desired mopping application. Tail bands 26 also keep the twisted and looped web elements 20 spaced apart during mopping and during laundering to increase the mop's cleaning effectiveness and to allow the individual web elements 20 to be effectively cleaned during laundering. It is to be understood that a single length of twisted web element 20 can be looped back-and-forth to create mop head 12, or numerous twisted and looped lengths of twisted web element 20 could be used to create mop head 12 without departing from the scope of the present invention.

Figure 3:
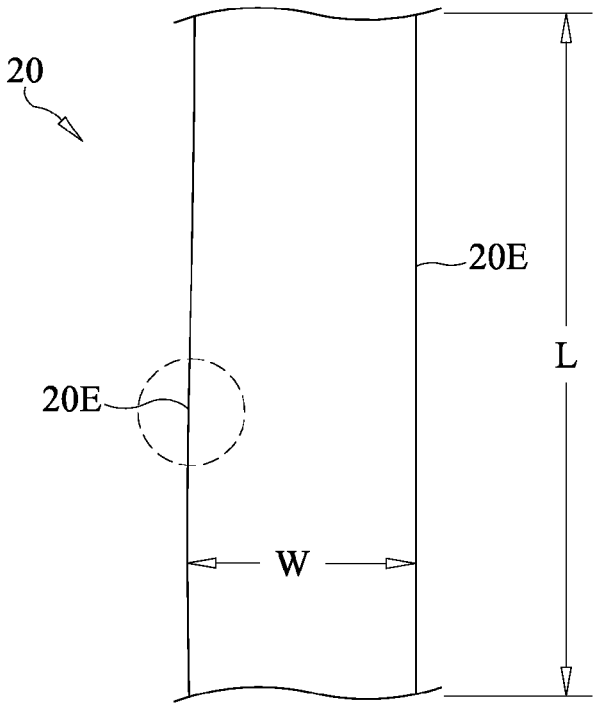
FIG. 3 is a plan view of a strip of planar material used to form a web element in accordance with an embodiment of the present invention.
Figure 4:
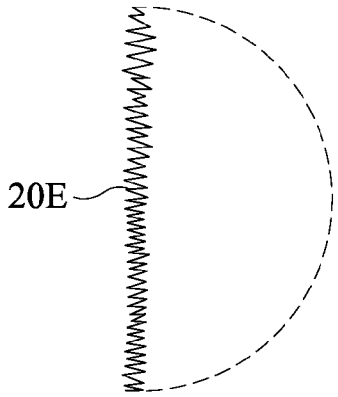
FIG. 4 is an enlarged view of a portion of an edge of the strip of planar material appearing in the dashed-line-circle region thereof illustrated in FIG. 3.

Referring additionally now to FIGS. 3-7, details of a single web element 20 in accordance with the present invention will now be described. In FIGS. 3-4, web element 20 is illustrated in its pre-processed form. In general, the pre-processed form of web element 20 is a strip of material on the order of 0.25-2.0 inches in width ("W") and a length ("L") that can be on the order of 5-6 feet (if a mop head is to be made from individual lengths of web elements 20) to a couple of hundred feet (if a mop head is to be made from a continuous length of a single web element 20).

Suitable materials for web element 20 include a wide variety of woven and/or non-woven materials made from natural and/or synthetic components as well as combinations thereof. A number of such suitable materials are described in the afore-mentioned U.S. Pat. No. 4,995,133, the contents of which are hereby incorporated by reference. In general, the choice of material(s) for web element 20 should allow for self-fusing to occur at regions thereof when the web element is exposed to heat for a period of time as will be explained further below. The amount of heat and time required for such self-fusing will vary based on the melting or fusing point associated with the material(s) being used. It is to be understood that the material(s) used as well as the structure of the planar strip (e.g., single ply, multi-ply laminate, etc.) can be varied to suit the needs of a particular application without departing from the scope of the present invention.

Regardless of the type of material(s) used for web element 20, opposing longitudinal edges 20E thereof will be fibrous as clearly shown in the enlarged view thereof presented in FIG. 4. Fibrous edges 20E can be due to the nature of the material(s) used and/or due to the way the strip was generated (e.g., a waste cut from an ancillary fabrication process using a larger bolt of the same material(s)). In general, fibrous edges 20E are mechanically weak. However, if the material(s) used for web element 20 can experience self-fusing when exposed to heat (or some other fusing catalyst processing), the strength of the web element at fibrous edges 20E can be improved. As used herein, the term "self-fusing" means that fibers in fibrous edges 20E fuse to each other as will be explained further below.

Figure 5A:
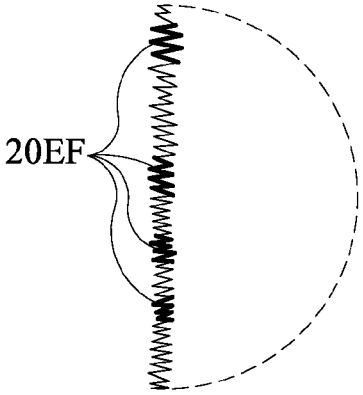
FIG. 5A is the enlarged view of the portion of an edge of the strip of planar material after the edge has undergone self-fusion at small areas thereof to thereby form fused fiber regions.
Figure 5B:
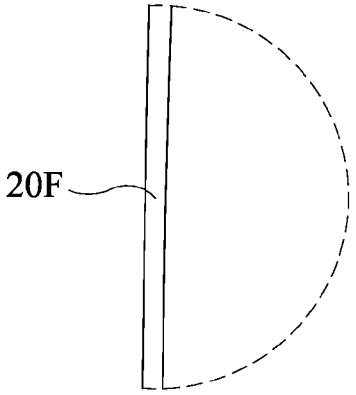
FIG. 5B is the enlarged view of the portion of an edge of the strip of planar material after the edge has undergone extensive self-fusion to thereby form a fused bead.

In accordance with the present invention, "self-fusing" at fibrous edge 20E can be achieved somewhat microscopically or locally at small groups of fibers at fibrous edge 20E, or on a more macro level along some of all of fibrous edge 20E. Accordingly, FIG. 5A illustrates the enlarged view of fibrous edge 20E shown in FIG. 4 where the fibrous edge has undergone small amounts of local fusing such that groups of adjacent fibers from fibrous edge 20E are fused together (e.g., melted, heat set, etc.) to form small fused fiber regions indicated by the bold-line edge areas designated by reference numeral 20EF. Depending on the material used, the type of fusing "catalyst", and/or the length of time the material is exposed to a fusing "catalyst", a greater amount of fusing can occur along fibrous edge 20E. Accordingly, FIG. 5B illustrates the enlarged view shown in FIG. 4 when the fibrous edge has undergone extensive self-fusing to thereby form a fused bead 20F. Fused bead 20F can be continuous or discontinuous along the length of the strip without departing from the scope of the present invention. It is to be understood that the self-fusing examples in FIGS. 5A and 5B depict approximate minimum (FIG. 5A) and maximum (FIG. 5B) levels of self-fusing, and that the term "self-fusing" as used herein is meant to include the range of self-fusing between the depicted minimum and maximum levels. It is further to be understood that self-fusing in the present invention is meant to include self-fused edges that combine different levels of self-fusing.

Figure 6:
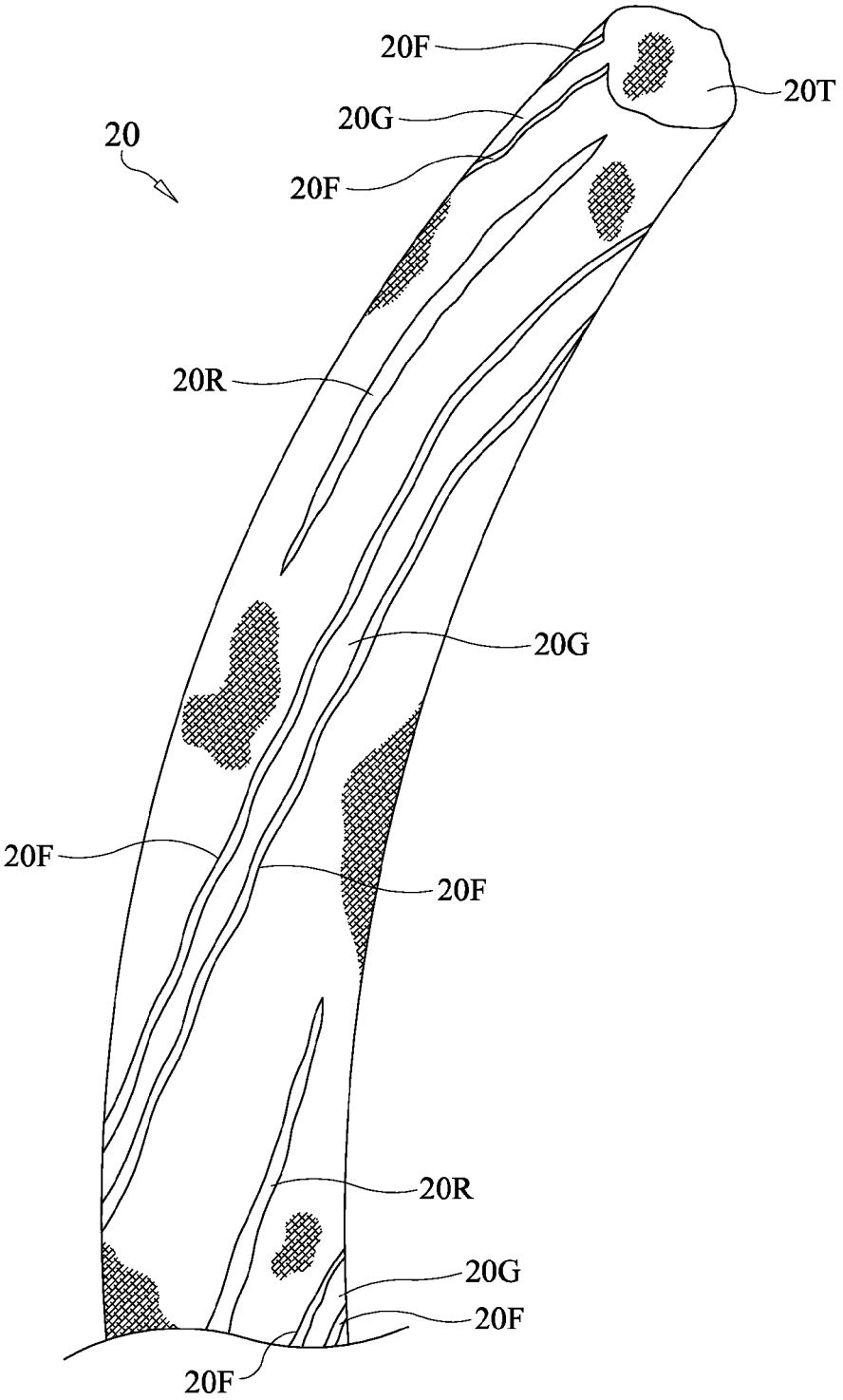
FIG. 6 is a side view of the strip of planar material after it has been twisted and heated to form self-fused regions therealong in accordance with an embodiment of the present invention.
Figure 7:
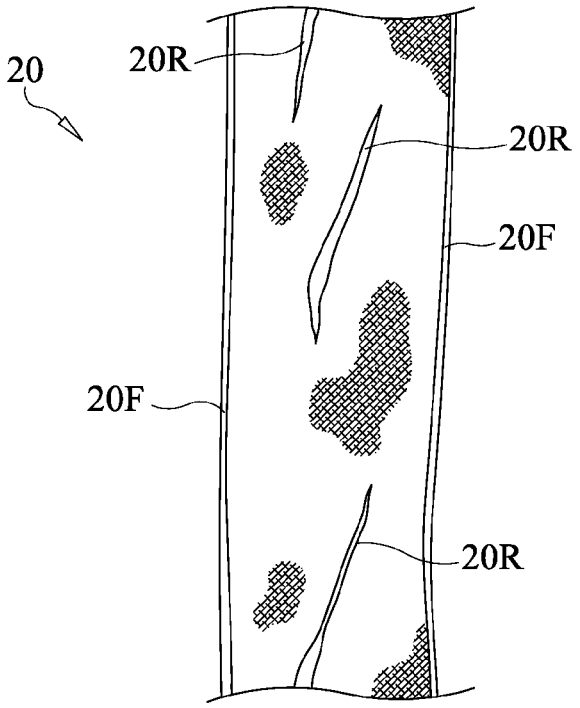
FIG. 7 is a plan view of the strip of planar material as it would appear if it were untwisted in order to illustrate the self-fused regions created through heat processing.

Regardless of the amount of self-fusion that takes place at fibrous edge 20E, the resulting self-fused edge (or regions thereof) is mechanically stronger than without self-fusing. Additionally, the self-fusing permanently alters the fiber memory thereby allowing the creation and retention of new shapes. The present invention takes advantage of the fusibility of the web element's material(s) in order to construct a twisted and looped web element for use in a mop head. That is, the present invention's twisted mop element includes regions of self-fusing that improve the mop element's mechanical strength and function to retain the mop element's twist. A portion of a twisted web element 20 with fused regions therealong is illustrated in FIG. 6. For purposes of explanation only, an untwisted and flattened illustration of web element 20 with fused regions formed therealong is shown in FIG. 7. Web element 20 is twisted in a longitudinal fashion to define a tubular structure defining a tubular region 20T. By way of example and for simplicity of illustration, web element 20 in FIGS. 6 and 7 has fused bead regions 20F. However, as explained above, the amount/degree of self-fusing that occurs can be different without departing from the scope of the present invention.

The amount of twist introduced in web element 20 is slight (i.e., between approximately 0.01 turns per inch and approximately 0.95 turns per inch) so that gentle helical gaps 20G are formed along the length of twisted web element 20 as shown in FIG. 6. Gaps 20G define an entryway to tubular region 20T formed within twisted web element 20. In general, the use of wider strips and/or dense materials will utilize less turns per inch than narrower and/or less dense material. In all cases, the turns per inch used should create helical gaps 20G to allow liquid and/or particulate matter to be absorbed and retained within tubular region 20T, and then released from tubular region 20T when the web element is compressed (e.g., when a mop made from the twisted web elements is squeezed out).

Figure 8A:
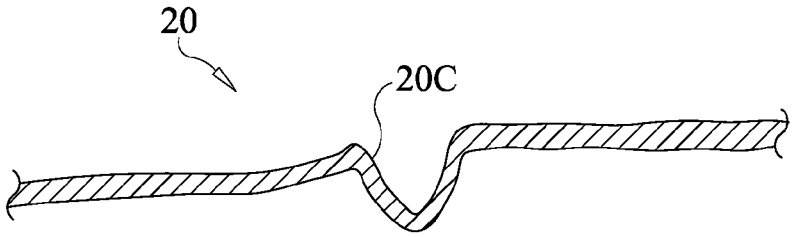
FIG. 8A is a cross-sectional view of a crease/pleat formed along a web element during twist processing thereof.
Figure 8B:
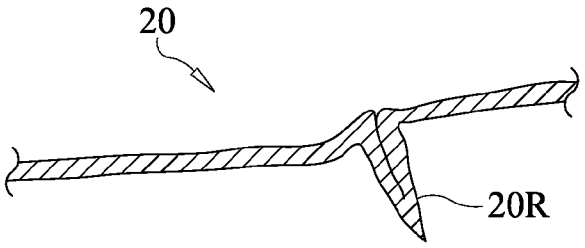
FIG. 8B is a cross-sectional view of the crease/pleat after it has undergone self-fusion to form a self-fused region along the twisted web element.

In addition to the above-described gentle twist, twisted web element 20 will undergo some heat processing that forms self-fused beads 20F (described above) as well as other self-fused regions 20R along the length of twisted web element 20. If such heat processing is performed while the web element is being twisted, self-fused regions 20R will occur generally along the twisted length of twisted web element 20 as best illustrated in an untwisted and flattened drawing thereof presented in FIG. 7. Self-fused regions 20R extend generally along the twisted length of twisted web element 20 because twist processing generally involves some tensioning of the web element along its length such that slight creases or pleats can be formed randomly therealong. These creases/pleats serve as the sites for the formation of self-fused regions 20R by virtue of heat processing. A cross-section of a crease/pleat 20C prior to the fusing thereof is illustrated in FIG. 8A, and a cross-section of the crease/pleat after undergoing self-fusion to form self-fused region 20R is illustrated in FIG. 8B. Additionally or alternatively, such self-fused regions could be generated to define some orderly pattern without departing from the scope of the present invention. Neither fused beads 20F nor fused regions 20R impede gaps 20G or tubular region 20T. Accordingly, twisted web element 20 (FIG. 6) can achieve uniform absorption, retention, and release properties all along its length.

Testing has shown that the inclusion of self-fused beads 20F and self-fused regions 20R set and retain the twisted tubular structure of twisted web element 20 illustrated in FIG. 6. That is, self-fused beads 20F and self-fused regions 20R permanently alter the mechanical memory of the material from its pre-processed planar strip form (FIG. 3) to its post-processing twisted tubular structure (FIG. 6). Further, it has also been found that the twisted tubular structure (FIG. 6) is retained even after multiple uses and laundering. Thus, the properties and advantages achieved by twisted web element 20 (FIG. 6) will last throughout the life of a mop constructed therefrom. Still further, the self-fusing along the edges of a web element (e.g., fused bead 20F) and along the body of a twisted tubular web element (e.g., fused regions 20R) add a texture to the surface of the twisted web element such that mops made therefrom will improve a user's ability to scrub a floor surface as the mop is swabbed thereover.

Figure 9:
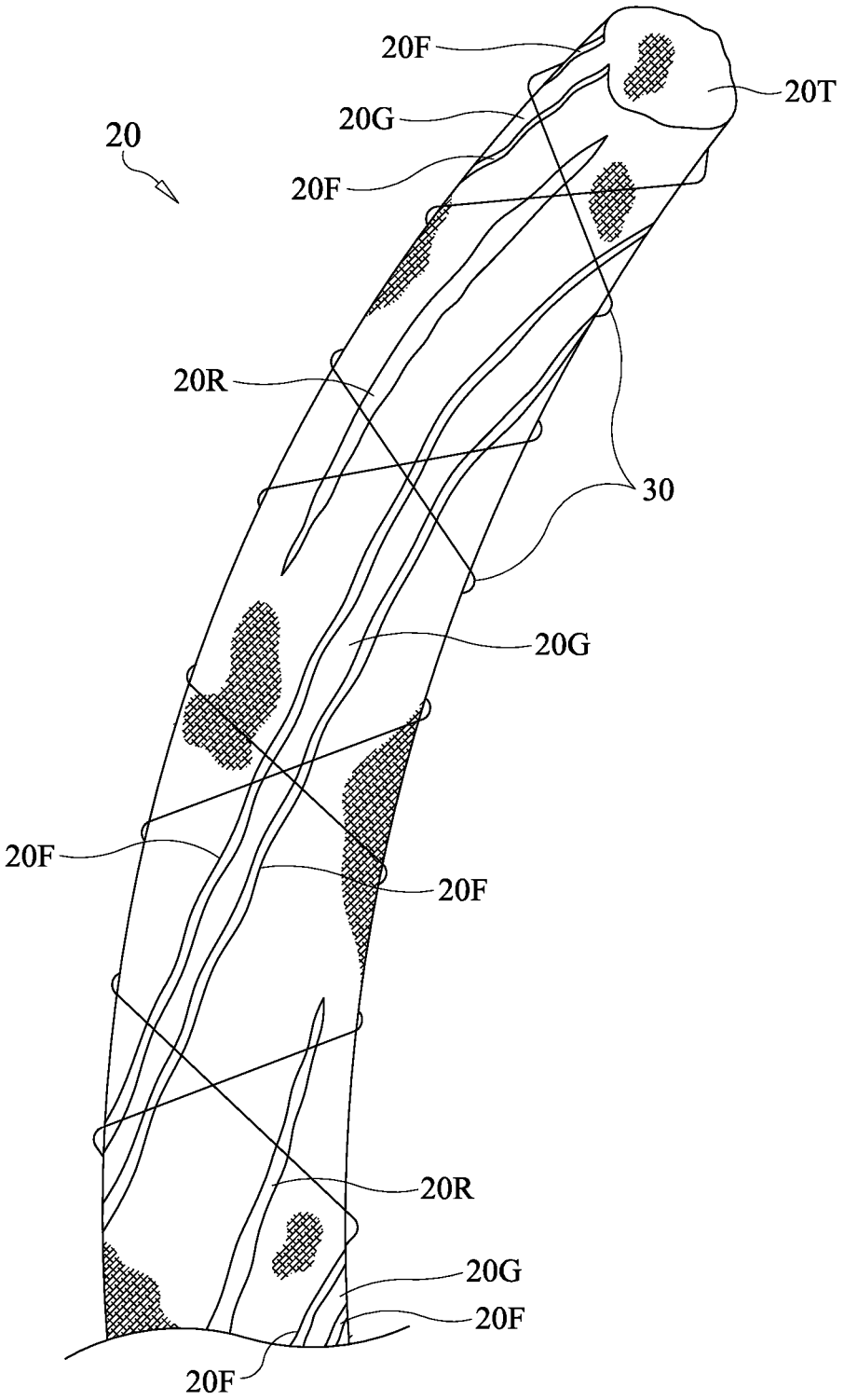
FIG. 9 is a side view of the twisted mop element of FIG. 6 with netting disposed thereabout in accordance with another embodiment of the present invention.

The above-described web element can be made more durable while maintaining the absorption, retention, and release attributes. For example, FIG. 9 illustrates a twisted web element 20 (similar to that described above and shown in FIG. 6) with a netting 30 disposed thereabout along the length thereof. Netting 30 can be made from a durable fiber to include man-made and natural polymers. Netting 30 provides circumferential support of twisted web element 20 without having to apply a tightly-controlled compression force thereto in order to stay in place. Accordingly, the integrity of gaps 20G and tubular region 20T are retained, while netting 30 can serve as a durable contact point for a rough floor surface and provide support for the web element structure throughout multiple launderings and dryings. Note that netting could also be used with untwisted web elements to improve the durability thereof when used in mops.

Figure 10:
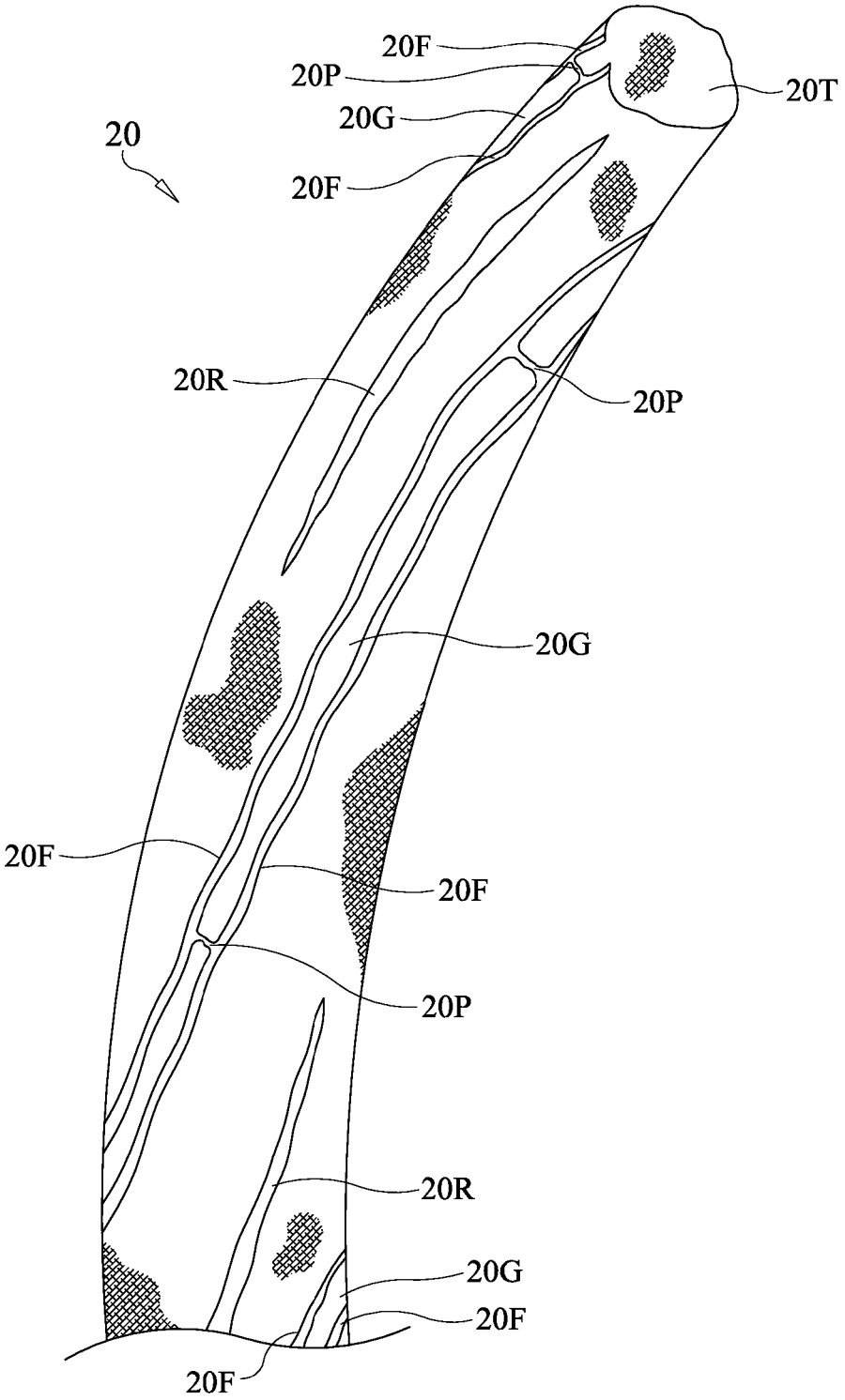
FIG. 10 is a side view of the strip of planar material after it has been twisted and heated to form self-fused regions therealong in accordance with another embodiment of the present invention.

The above-described twisted web element can also be fabricated to define a number of tack points at a number of places along the web element's helical gaps. For example, FIG. 10 illustrates a twisted web element 20 (similar to that described above and shown in FIG. 6) with a number of tack points 20P being formed along gaps 20G. Each tack point 20P is a point of self-fusing between two fused beads 20F. Tack points 20P could be provided for by adjusting the amount of heat and/or dwell time for such heat application during processing.

The advantages of the present invention are numerous. The twisted web element defines a memory-altered tubular structure that absorbs and retains liquid and/or particulate from a floor surface via its well-defined and maintained gapped, tubular structure. Maintenance of the gapped and tubular structure is achieved via self-fused edges and regions of the twisted web element that do not impede liquid/particulate absorption, retention, or release. The tubular structure of the twisted web element is retained even throughout multiple uses and multiple launderings.

Although the invention has been described relative to a specific embodiment thereof, there are numerous variations and modifications that will be readily apparent to those skilled in the art in light of the above teachings. For example, since twisted web elements in accordance with the present invention will retain their shape, the present invention could be used to produce mops with cut ends, i.e., free end loops 28 shown in FIGS. 1 and 2 are essentially cut off from mop head 12 leaving open-ended twisted web elements. In another embodiment, rather than starting with planar strips (or web elements as they are referred to herein), the present invention could be adapted for use in making twisted fiber products where the individual fibers in the product experience fusing. In this case, fusing will generally occur between adjacent fibers such that loosely-twisted fiber products will not readily separate during handling and use. Netting (such as that described above) could also be disposed about the length of such a twisted fiber product. In still another embodiment of the present invention, a twisted tubular web element could be set in its shape by undergoing a wetting-and-drying process where such processing effectiveness is governed primarily by the properties of the material(s) used for the web element. It is therefore to be understood that, within the scope of the appended claims, the invention may be practiced other than as specifically described.

What is claimed as new and desired to be secured by Letters Patent of the United States is:

1. A tubular web element, comprising a strip of fabric having opposing longitudinal edges, said strip being longitudinally twisted to define a hollow tube having between approximately 0.01 turns per inch to approximately 0.95 turns per inch along a length of said hollow tube wherein at least one helical gap is defined between said opposing longitudinal edges, said opposing longitudinal edges having self-fused edge regions therealong, said hollow tube having self-fused longitudinally-extending regions between said opposing longitudinal edges.

2. A tubular web element as in claim 1, wherein said self-fused edge regions comprise spaced-apart regions of fused fibers.

3. A tubular web element as in claim 1, wherein said self-fused edge regions comprise fused fibers defining a bead along at least a portion of each of said opposing longitudinal edges.

4. A tubular web element as in claim 1, wherein said self-fused longitudinally-extending regions comprise pleats of said fabric fused together.

5. A tubular web element as in claim 1, wherein said self-fused edge regions comprise:

spaced-apart regions of fused fibers; and fused fibers defining a bead along at least a portion of at least one of said opposing longitudinal edges.

6. A tubular web element as in claim 1, further comprising a net disposed about said hollow tube.

7. A tubular web element as in claim 1, wherein said hollow tube is retained in a loop shape having two substantially adjacent and spaced-apart legs terminating in a looped end.

8. A tubular web element structure, comprising:

a plurality of strips of fabric, each of said strips of fabric having opposing longitudinal edges, each of said strips being longitudinally twisted to define a hollow tube having between approximately 0.01 turns per inch to approximately 0.95 turns per inch along a length of said hollow tube wherein at least one helical gap is defined between said opposing longitudinal edges of each said hollow tube, said opposing longitudinal edges of each said hollow tube having self-fused edge regions therealong, each said hollow tube having self-fused longitudinally-extending regions between said opposing longitudinal edges, and each said hollow tube being retained in a loop shape having two substantially adjacent and spaced-apart legs terminating in a looped end.

9. A tubular web element structure as in claim 8, wherein said self-fused edge regions comprise spaced-apart regions of fused fibers.

10. A tubular web element structure as in claim 8, wherein said self-fused edge regions comprise fused fibers defining a bead along at least a portion of each of said opposing longitudinal edges.

11. A tubular web element structure as in claim 8, wherein said self-fused longitudinally-extending regions comprise pleats of said fabric fused together.

12. A tubular web element structure as in claim 8, wherein said self-fused edge regions comprise:

spaced-apart regions of fused fibers; and fused fibers defining a bead along at least a portion of at least one of said opposing longitudinal edges.

13. A tubular web element structure as in claim 8, further comprising a net disposed about each said hollow tube.

14. A tubular web element, comprising a strip of fabric having opposing longitudinal edges, said strip being longitudinally twisted to define a hollow tube having between approximately 0.01 turns per inch to approximately 0.95 turns per inch along a length of said hollow tube wherein at least one helical gap is defined between said opposing longitudinal edges, said opposing longitudinal edges having self-fused edge regions therealong defined by at least one of spaced-apart regions of fused fibers and fused fibers defining a bead along at least a portion of said opposing longitudinal edges, said hollow tube having self-fused longitudinally-extending pleats of said fabric between said opposing longitudinal edges.

15. A tubular web element as in claim 14, further comprising a net disposed about said hollow tube.

16. A tubular web element as in claim 14, wherein said hollow tube is retained in a loop shape having two substantially adjacent and spaced-apart legs terminating in a looped end.

* * * * *